US005651698A

United States Patent [19]

Locati et al.

[11] Patent Number: 5,651,698

[45] Date of Patent: Jul. 29, 1997

[54] COAXIAL CABLE CONNECTOR

[75] Inventors: Ronald Peter Locati, Elmira; Andrew James Kempf, Horseheads; Bruce C. Hauver, Sr., Elmira; David Edward Dunham, Pine City; David James Stabile, Horseheads; Thomas George Macek, Endicott, all of N.Y.; Larry Michael Massaglia, Crestline, Calif.

[73] Assignee: Augat Inc., Mansfield, Mass.

[21] Appl. No.: 569,582

[22] Filed: Dec. 8, 1995

[51] Int. Cl.[6] ..... H01R 17/18

[52] U.S. Cl. ..... 439/578; 439/583; 439/584

[58] Field of Search ..... 439/578, 583, 439/584, 585, 271, 272, 273

[56] References Cited

U.S. PATENT DOCUMENTS

| | | | |
|---|---|---|---|
| 3,336,563 | 8/1967 | Hyslop | 339/61 |
| 3,474,391 | 10/1969 | Gartzke et al. | 339/103 |
| 3,541,495 | 11/1970 | Ellis et al. | 339/177 |
| 3,706,958 | 12/1972 | Blanchenot | 339/177 E |
| 3,744,011 | 7/1973 | Blanchenot | 339/177 R |
| 3,847,463 | 11/1974 | Hayward et al. | 339/8 P |
| 4,346,958 | 8/1982 | Blanchard | 339/177 R |
| 4,583,811 | 4/1986 | McMills | 339/177 R |
| 4,648,684 | 3/1987 | Mattis et al. | 339/177 R |
| 4,674,818 | 6/1987 | McMills et al. | 439/275 |
| 4,717,355 | 1/1988 | Mattis | 439/452 |
| 4,854,893 | 8/1989 | Morris | 439/578 |
| 4,952,174 | 8/1990 | Sucht et al. | 439/584 |
| 4,993,964 | 2/1991 | Trummer | 439/272 |
| 5,011,432 | 4/1991 | Sucht et al. | 439/584 |
| 5,194,012 | 3/1993 | Cairns | 439/271 |
| 5,195,906 | 3/1993 | Szegda | 439/394 |
| 5,342,218 | 8/1994 | McMills et al. | 439/578 |
| 5,352,134 | 10/1994 | Jacobsen et al. | 439/584 |

OTHER PUBLICATIONS

"Trimline" Cable Connectors, *Magnavox CATV Systems, Inc.* brochure (undated).

*Primary Examiner*—David L. Pirlot
*Assistant Examiner*—Tho Dac Ta
*Attorney, Agent, or Firm*—Weingarten, Schurgin, Gagnebin & Hayes LLP

[57] ABSTRACT

A cable connector is comprised of at least a first piece including a ferrule having serrations for mechanically connecting with different parts of a coaxial cable, a mandrel and a closing collar. A second piece of the connector is comprised of an entry body including a pin terminal, a support insulator and an actuator. Additionally, the connector provides a visual determination of the complete mating of one piece of the connector to the other.

18 Claims, 4 Drawing Sheets

COAXIAL CABLE CONNECTOR

FIELD OF THE INVENTION

The invention relates generally to electrical connectors, and more particularly to coaxial cable connectors used in conjunction with either semi-rigid coaxial cable or flexible coaxial cable.

BACKGROUND OF THE INVENTION

Coaxial cables typically consist of a central conductor which is surrounded by a metallic outer conductor. An insulator separates the central conductor from the outer conductor, and an insulating jacket covers the outer conductor. The outer conductor is usually in one of two forms, either a copper braid or an aluminum sheath.

Coaxial cables of this type are used broadly, especially in cable television applications. The coaxial cable provides for high quality transportation of signals. In order to effectively use the cables, a connector must be fitted to at least one end of the cable. A connector, in order to be practical, must provide for a reliable mechanical and electrical connection as well as being simple to install and use. It is further desirable that the connector positively release the center conductor upon disassembly and that the connector hold the cable stationary during twisting of the clamp nut.

SUMMARY OF THE INVENTION

A coaxial cable connector is disclosed. A first piece of the connector is comprised of a clamp nut including a ferrule, a mandrel and a closing collar. A second piece of the connector comprises an entry body having a pin terminal, a support insulator, and an actuator. Additionally there are o-rings placed between various parts of the connector to provide for sealing integrity and prevent RF performance degradation. As the connector pieces are mated together a secure connection between the connector and the coaxial cable is produced. The design is easily expandable to other variations including, but not limited to, a flexible drop cable, a splice connector, and a feed-through connector as well as being used in conjunction with other cable types and sizes.

BRIEF DESCRIPTION OF THE DRAWINGS

The invention will be more fully understood from the following detailed description taken in conjunction with the accompanying drawing in which.

DETAILED DESCRIPTION

Figure 1:
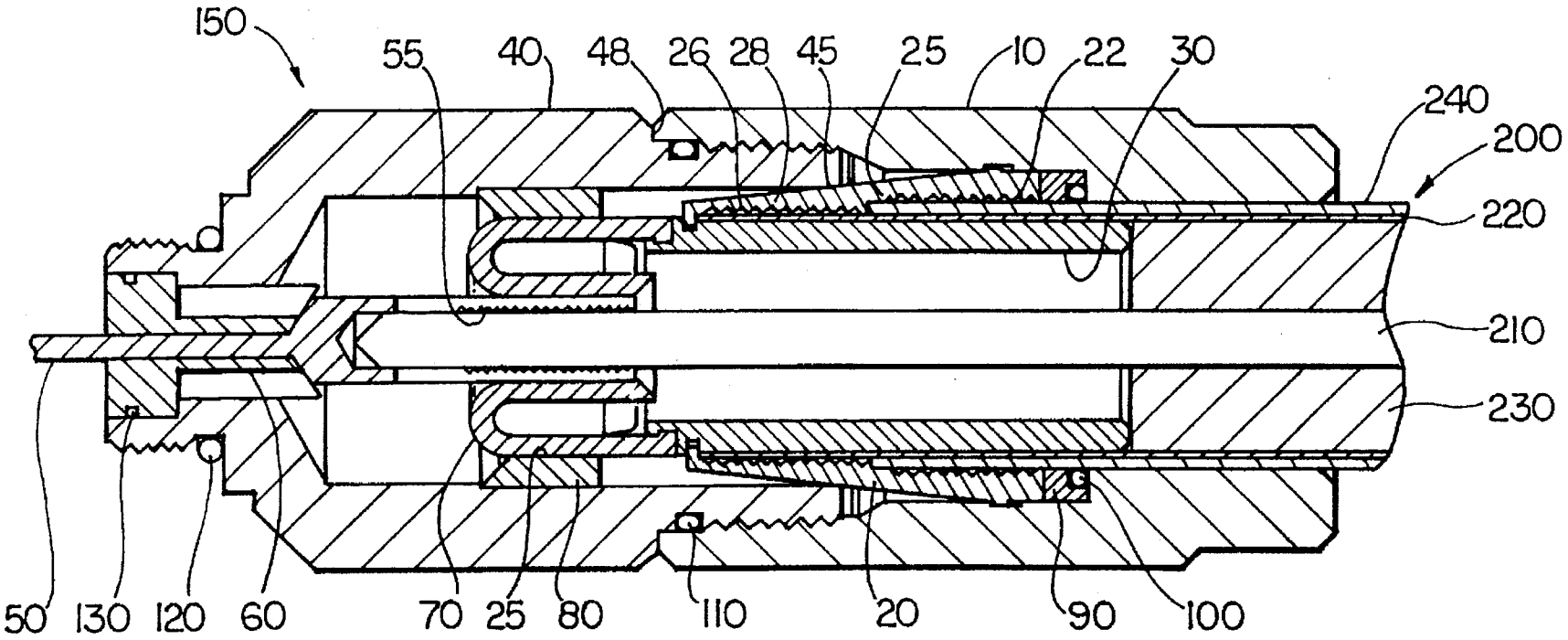
FIG. 1 is a cross-sectional view of a first embodiment of the connector.
Figure 2:
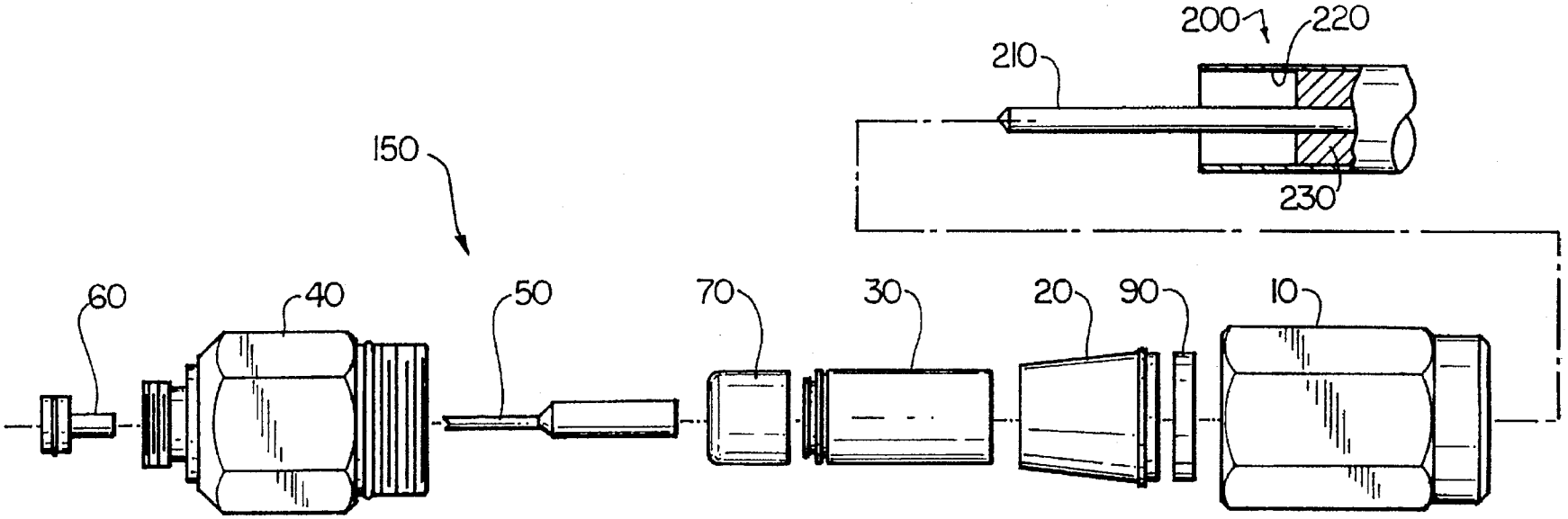
FIG. 2 is an exploded view of the connector of FIG: 1.

FIG. 1 and FIG. 2 show a first embodiment of a coaxial connector according to the present invention. A first piece of the connector is comprised of a clamp nut 10 including a ferrule 20, a mandrel 30 and closing collar 70. A second piece of the connector is comprised of an entry body 40 having a pin terminal 50, a support insulator 60 and an actuator 80.

In this embodiment a length of coaxial cable 200 is provided to the clamp nut 10 of coaxial connector 150. The coaxial cable has had one end prepared for having the connector assembled onto. As a result of the preparation of an end, the coaxial cable 200 has a length of center conductor 210 exposed approximately flush to the face of the closing collar, thus there is no need to "measure" the preparation length, as may be required by other connectors. An additional section of cable insulator 230, approximately 1.2 inches in length, has been removed. Additionally, an end most section of insulating jacket 240, approximately 0.5 inches in length, has been removed exposing the conductive sheath 220.

The prepared end of coaxial cable 200 is inserted into a rear end of clamp nut 10. The length of clamp nut 10 provides cable strain relief as well as providing RF leakage protection. Mandrel 30 is non-conductive, therefore it can be fabricated from non-conductive material, it can be comprised of a metal insert with a plastic surrounding or it can be comprised of metallized plastic. By implementing a non-conductive mandrel, the RF performance of the connector is improved, since the frequency resonance inherent in a metal version is not present. Mandrel 30 has closing collar 70, also non-conductive, attached at a distal end and is inserted into a front end of clamp nut 10. Clamp nut 10 is electrically conductive and is comprised of aluminum in this embodiment, although other conductive materials could be used. As the prepared end of coaxial cable 200 enters clamp nut 10, center conductor 210 is encircled by and extends beyond mandrel 30 and closing collar 70, and a large percentage of mandrel 30 itself is encircled by conductive sheath 220.

An end of mandrel 30 not surrounded by conductive sheath 220 is engaged with an end of ferrule 20. Ferrule 20 is comprised of aluminum in this embodiment although other conductive materials could also be used, and is positioned so that when entry body 40 is integrated with clamp nut 10, the serrations 22 on a first step 25 of ferrule 20 will come into to contact with insulating jacket 240 of coaxial cable 200, and serrations 26 on a second step 28 of ferrule 20 will be brought into contact with conductive sheath 220.

Entry body 40 is also electrically conductive and in this embodiment is comprised of aluminum, though other conductive materials could be used. Entry body 40 includes at a front end a support insulator 60 through which extends pin terminal 50. Pin terminal 50 has an open end which surrounds center conductor 210. Support insulator 60 includes a plurality of serrated annular rings (65") for sealing the pin terminal 50 to the support insulator 60.

The connector 150 is assembled by integrating a rear end of entry body 40 into a front end of clamp nut 10. As a result of entry body 40 being integrated with clamp nut 10, the cam surface 85 of actuator 80 is brought into contact with closing collar 70 and exerts force on closing collar 70 which in turn presses against pin terminal 50, causing the serrations 55 on an internal surface of pin terminal 50 to provide a secure mechanical and electrical connection between pin terminal 50 and center conductor 210 of coaxial cable 200. The connection to center conductor 210 provides maximum tensile force with a minimum of conductor damage. The closure of pin terminal 50 onto center conductor 210 is self-limiting, and is insensitive to the degree of nut tightness, thereby providing a more consistent and repeatable closure process.

As the rear end of entry body 40 enters the front end of clamp nut 10, front ends of ferrule 20 are forced inwards by the action of entry body internal shoulder 45 forcibly contacting the truncated conical exterior surface of ferrule 20, causing the serrations on the first step of the ferrule to press against insulating jacket 240. Accordingly, coaxial cable 200 is secured in place between the first step of ferrule 20 and mandrel 30. Additionally, as the front ends of ferrule 20 are forced inwards, the serrations on a second step of ferrule 20 are forced against conductive sheath 220 of coaxial cable 200 and mandrel 30. The conductive sheath 220 is uniformly gripped without deformation and weakening, as compared to prior art connectors, which can cause significant pleating of the conductive sheath. The closure of ferrule 20 onto the coaxial cable 200 is self-limiting, and is insensitive to the degree of nut tightness, thereby providing a more consistent and repeatable closure process. Accordingly, a secure electrical and mechanical connection between ferule 20 and conductive sheath 220 is produced.

Figure 3:
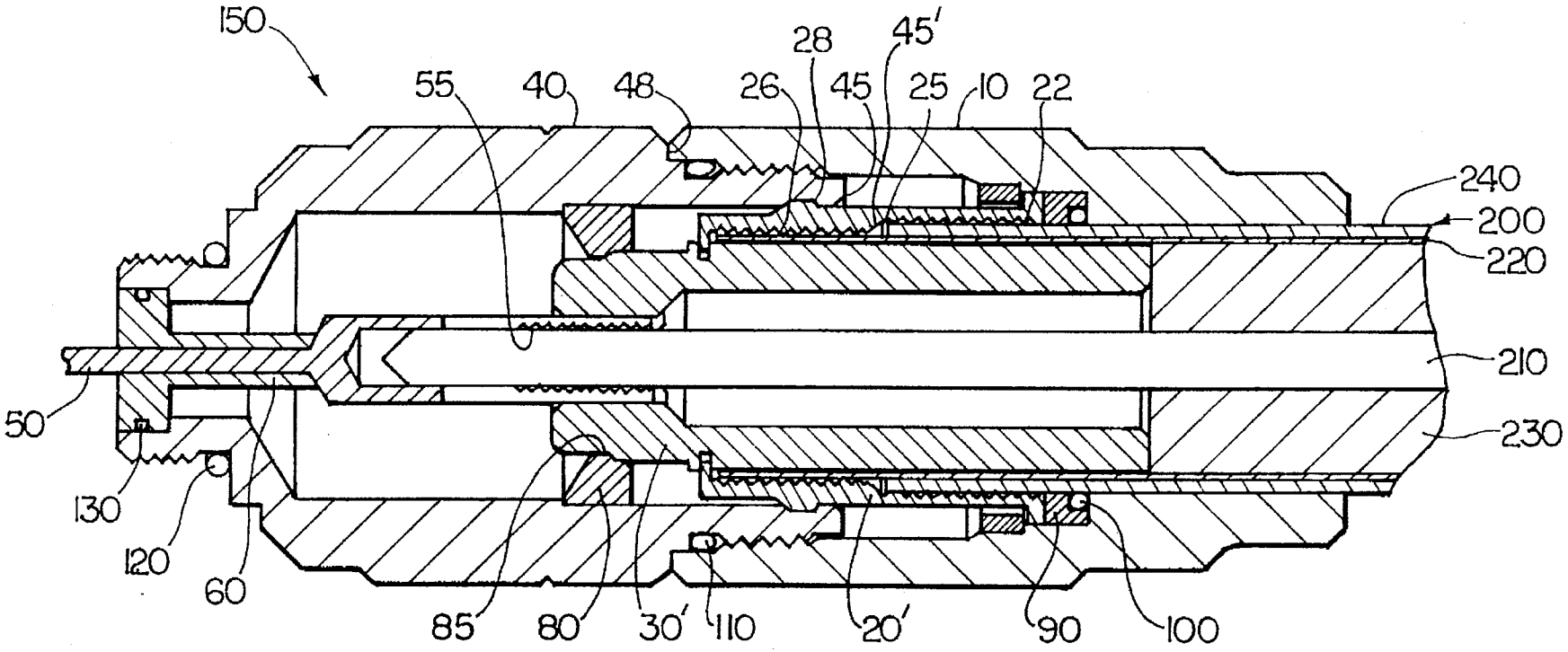
FIG. 3 is a cross-sectional view of a second embodiment of the connector.
Figure 4:
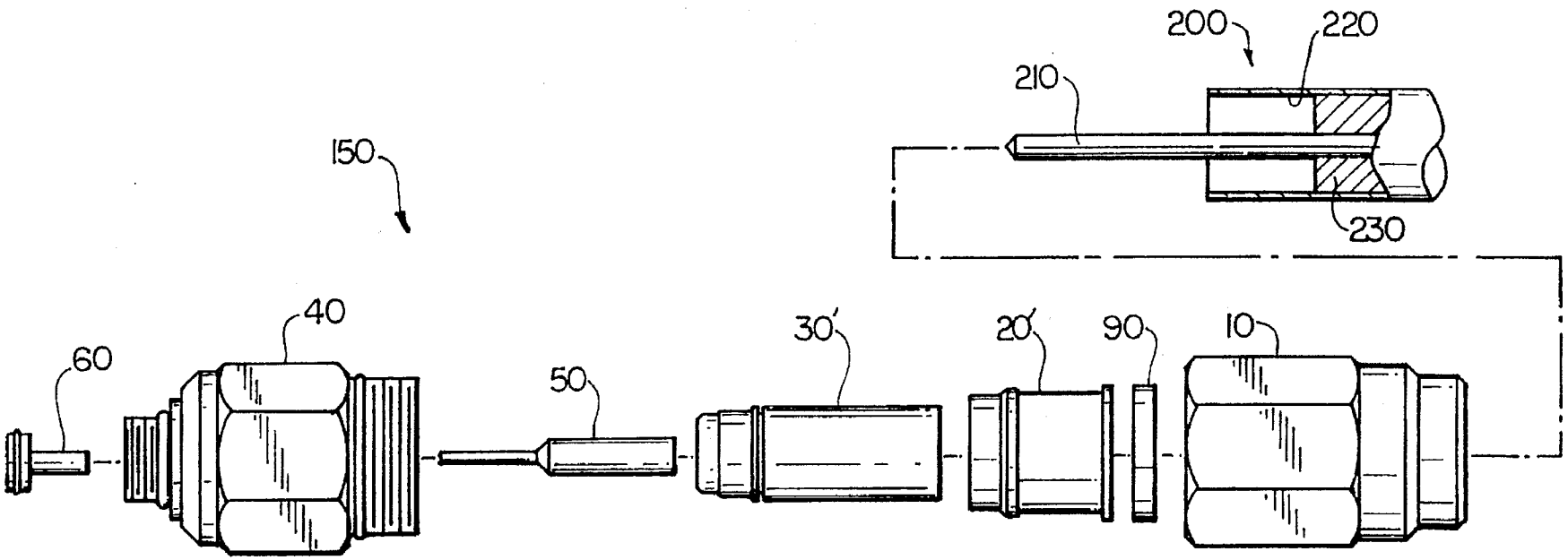
FIG. 4 is an exploded view of the connector of FIG. 3.

FIG. 3 and FIG. 4 show a second embodiment of a coaxial connector according to the present invention. A first piece of the connector is comprised of a clamp nut 10 including a ferrule 20', and a mandrel 30' having an integrated closing collar. A second piece of the connector is comprised of an entry body 40 having a pin terminal 50, a support insulator 60 and an actuator 80.

In this second embodiment a length of coaxial cable 200 is provided to the clamp nut 10 of coaxial connector 150. The coaxial cable has had one end prepared for having the connector assembled onto. As a result of the preparation of an end, the coaxial cable 200 has a length of center conductor 210 exposed approximately flush to the face of the closing collar, thus there is no need to "measure" the preparation length, as may be required by other connectors. An additional section of cable insulator 230, approximately 1.2 inches in length, has been removed. Additionally, an end most section of insulating jacket 240, approximately 0.5 inches in length, has been removed exposing the conductive sheath 220.

The prepared end of coaxial cable 200 is inserted into a rear end of clamp nut 10. The length of clamp nut 10 provides cable strain relief as well as providing RF leakage protection. Mandrel 30' is non-conductive in this embodiment, therefore it can be fabricated from non-conductive material, it can be comprised of a metal insert with a plastic surrounding, or it can be comprised of metallized plastic. By implementing a non-conductive mandrel, the RF performance of the connector is improved, since the frequency resonance inherent in a metal version is not present. Clamp nut 10 is electrically conductive and is comprised of aluminum in this embodiment, although other conductive materials could be used. As the prepared end of coaxial cable 200 enters clamp nut 10, center conductor 210 is encircled by and extends beyond mandrel 30' and a portion of mandrel 30' itself is encircled by conductive sheath 220.

A section of mandrel 30' not surrounded by conductive sheath 220 is engaged with an end of ferrule 20. Ferrule 20' is comprised of aluminum in this embodiment although other conductive materials could also be used, and is positioned so that when entry body 40 is integrated with clamp nut 10, the serrations 22 on a first step 25 of ferrule 20' will come into to contact with insulating jacket 240 of coaxial cable 200, and serrations 26 on a second step 28 of ferrule 20' will be brought into contact with conductive sheath 220.

Entry body 40 is also electrically conductive and in this embodiment is comprised of aluminum, though other conductive materials could be used. Entry body 40 includes at a front end a support insulator 60 through which extends pin terminal 50. Pin terminal 50 has an open end which surrounds center conductor 210. Support insulator 60 includes a plurality of serrated annular rings (65') for sealing the pin terminal 50 to the support insulator 60.

The connector 150 is assembled by integrating a rear end of entry body 40 into a front end of clamp nut 10. As a result of entry body 40 being integrated with clamp nut 10, the cam surface 85 of actuator 80 is brought into contact with mandrel 30'. Actuator 80 exerts force on mandrel 30' which in turn presses against pin terminal 50, causing the serrations 55 on an internal surface of pin terminal 50 to provide a secure mechanical and electrical connection between pin terminal 50 and center conductor 210 of coaxial cable 200. The connection to the center conductor 210 provides maximum tensile force with a minimum of conductor damage. The closure of pin terminal 50 onto center conductor 210 is self-limiting, and is insensitive to the degree of nut tightness, thereby providing a more consistent and repeatable closure process.

As the rear end of entry body 40 enters the front end of clamp nut 10, front ends of ferrule 20 are forced inwards by the action of entry body internal shoulder 45 forcibly contacting the cam surface 45' of ferrule 20', causing the serrations 22 on the first step 25 of the ferrule to press against insulating jacket 240. Accordingly, coaxial cable 200 is secured in place between the first step 25 of ferrule 20' and mandrel 30'. Additionally, as the front ends of ferrule 20' are forced inwards, the serrations 26 on a second step 28 of ferrule 20' are forced against conductive sheath 220 of coaxial cable 200 and mandrel 30'. The conductive sheath 220 is uniformly gripped without deformation and weakening, as compared to prior art connectors, which can cause significant pleating of the conductive sheath. The closure of ferrule 20' onto the coaxial cable 200 is self-limiting, and is insensitive to the degree of nut tightness, thereby providing a more consistent and repeatable closure process. Accordingly, a secure electrical and mechanical connection between ferrule 20' and conductive sheath 220 is produced.

It is important to note the "timing" of the closure of the connector with the coaxial cable. The closure of the ferrule 20 in the first embodiment, and ferule 20' in the second embodiment, onto the sheath 220 occurs before the closure of the pin terminal 50 onto the center conductor 210, in order to prevent distortion of the center conductor 210 due to excessive compressive load if the timing were otherwise.

A "positive stop" design allows for visual observation of entry body 40 being completely received by clamp nut 10, and can be made by noticing that the external shoulder 48 of entry body 40 is abutting against clamp nut 10. Additionally, there is tactile feedback when torquing the clamp nut, thus there are two indications of full, complete assembly of the connector.

Protection against contaminates and a reduction of the degradation of RF signals are provided. Located within clamp nut 10 is an o-ring carrier 90. O-ring carrier 90 is comprised of tin-plated brass in this embodiment, though other conductive materials could be used. O-ring carrier 90 allows the ferrule 20 in the first embodiment, and ferule 20' in the second embodiment, to freely rotate while under axial compression, fixedly holding the coaxial cable 200 during rotation of the clamp nut 10. O-ring carrier 90 has an annular race for securing o-ring 100 between coaxial cable 200 and clamp nut 10. In this manner the o-rings provide for a reduction in the degradation of RF signal performance. Additionally, the o-rings serve to seal out contaminants that accelerate galvanic corrosion. O-ring 110 is provided between entry body 40 and clamp nut 10, and o-ring 130 is provided between support insulator 60 and entry body 40, to keep contaminants from entering the connector. Additionally, a seal is also accomplished between the pin terminal 50 and support insulator 60 by the serrated rings of support insulator 60 (not shown). O-ring 120 is provided around the outside of entry body 40 so that a moisture free connection can be made between the connector and its intended receiver.

The o-rings are comprised of a material which provides ultra-violet light (UV) and ozone stability for maximum resistance to atmospheric ingress.

With such a design, the connector is reusable on the same cable or on another cable. The connector is not "craft sensitive", nor is the connector dependent on installation technique. Additionally, the connectors's pull back distance is minimized which allows for easier disconnects after installation. The connector is a "positive release" design in that the closing collar is removed along with the clamp nut 10 during unmating of the connector, thereby preventing locking of the center conductor 210 within pin terminal 50. The present connector is more easily mated and unmated "live" than other designs, due to the protected center conductor 210 being contained within closing collar 70 in one embodiment and mandrel 30' in another embodiment. This aspect is important since voltage and current levels are rising in cable systems.

Another connector embodiment includes incorporating a ferrule and nut assembly that closes onto a non-jacketed cable. The present design is also expandable to include such applications as a flexible or drop cable, a splice connector, a feed through connector as well as including other cable sizes and types. While two piece connectors have been described in detail, three piece connectors, which also incorporate the design features described above could be implemented as well.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. A two piece coaxial cable connector comprising:

a clamp nut open on each of two ends, said clamp nut defining an interior space, a first end of said clamp nut for receiving a coaxial cable, a portion of the interior space adjacent to a second end of said clamp nut having a mating area;

an entry body defining an interior space, said entry body open on each end, a first end of said entry body having a mating area cooperating with the mating area of the clamp nut;

a ferrule having a truncated conical exterior surface and a stepped interior surface, said ferrule centrally disposed along a common longitudinal axis within said clamp nut interior space, an outside surface of said ferrule abutting an end portion of said entry body;

a mandrel centrally disposed within said ferrule along a common longitudinal axis, said mandrel engaging a first end of said ferrule;

a closing collar centrally disposed about a common longitudinal axis with said clamp nut, a first end of said closing collar engaging a first end of said mandrel;

a pin terminal centrally disposed along a common longitudinal axis within said entry body, a first end of said pin terminal extending beyond a second end of said entry body, said pin terminal having a bore partially disposed longitudinally therein at a second end, said pin terminal bore having a plurality of serrations on an interior surface adjacent said bore second end;

a support insulator centrally disposed along a common longitudinal axis within a second end of said entry body, said support insulator having a bore centrally disposed therethrough for receiving said pin terminal; and an actuator centrally disposed along a common longitudinal axis within said entry body, said actuator having a cam shaped inner surface extending longitudinally therein, said actuator disposed so that said cam surface engages said closing collar.

2. The coaxial connector of claim 1 wherein a first step of said interior surface including a first plurality of annular serrations, a second step of said interior surface including a second plurality of annular serrations, said first plurality of serrations gripping an exterior insulating jacket of the coaxial cable, said second plurality of serrations providing electrical connections with a conductive sheath of the coaxial cable by movement of said first end of said entry body along said truncated conical exterior surface of said ferrule when said entry body is integrated with said clamp nut.

3. The coaxial connector of claim 1 wherein said ferrule has a stepped interior surface, a first step of said interior surface including a first plurality of annular serrations, a second step of said interior surface including a second plurality of annular serrations, said first plurality of serrations gripping an exterior insulating jacket of the coaxial cable, said second plurality of serrations providing electrical connections with a conductive sheath of the coaxial cable by movement of said first end of said entry body along a cam section of said exterior surface of said ferrule when said entry body is integrated with said clamp nut.

4. The coaxial connector of claim 1 wherein said entry body, said ferrule and said clamp nut are comprised of aluminum; and said pin terminal is comprised of tin-plated brass, silver-plated brass or other copper alloy.

5. The coaxial connector of claim 1 wherein said mandrel, said closing collar, said actuator, and said support insulator are comprised of an electrically insulating material.

6. The coaxial connector of claim 1 wherein said mandrel, said actuator, and said support insulator are comprised of an electrically insulating material.

7. A two piece coaxial cable connector comprising:

a clamp nut open on each of two ends, said clamp nut defining an interior space, a first end of said clamp nut for receiving a coaxial cable, a portion of the interior space adjacent to a second end of said clamp nut having a mating area;

an entry body defining an interior space, said entry body open on each end, a first end of said entry body having a mating area cooperating with the mating area of the clamp nut;

a ferrule having a stepped exterior surface including a cam section for engaging the entry body, said ferrule centrally disposed along a common longitudinal axis within said clamp nut interior space, an outside surface of said ferrule abutting an end portion of said entry body;

a mandrel centrally disposed within said ferrule along a common longitudinal axis, said mandrel engaging a first end of said ferrule, said mandrel including a closing collar;

a pin terminal centrally disposed along a common longitudinal axis within said entry body, a first end of said pin terminal extending beyond a second end of said entry body, said pin terminal having a bore partially disposed longitudinally therein at a second end, said pin terminal bore having a plurality of serrations on an interior surface adjacent said bore second end;

a support insulator centrally disposed along a common longitudinal axis within a second end of said entry body, said support insulator having a bore centrally disposed therethrough for receiving said pin terminal; and an actuator centrally disposed along a common longitudinal axis within said entry body, said actuator having a cam shaped inner surface extending longitudinally therein, said actuator disposed so that said cam surface engages said closing collar.

8. The coaxial connector of claim 1 or claim 7 wherein said pin terminal serrations are forced into electrical connections with a central conductor of the coaxial cable when said entry body is integrated with said clamp nut.

9. The coaxial connector of claim 1 or claim 7 wherein a visual sign of complete mating of said entry body to said clamp nut is provided by a shoulder of said entry body abutting against said second end of said clamp nut.

10. The coaxial connector of claim 1 or claim 7 further comprising:

a second o-ring disposed between an outside surface of said support insulator and an inside surface of said entry body;

a third o-ring disposed between an outside surface of said entry body and an inside surface of said clamp nut; and a fourth o-ring disposed about an external surface of said entry body.

11. The coaxial connector of claim 1 or claim 3 wherein said entry body, said ferrule, said clamp nut, and said pin terminal are electrically conductive.

12. The coaxial connector of claim 1 or claim 7 wherein said mandrel comprises a metal insert surrounded by plastic.

13. The coaxial connector of claim 1 or claim 7 wherein said mandrel comprises metallized plastic.

14. The coaxial connector of claim 1 or claim 7 wherein closing of said ferrule is self-limiting and independent of nut closure position.

15. The coaxial connector of claim 1 or claim 7 wherein closing of said pin terminal is self-limiting and independent of nut closure position.

16. The coaxial connector of claim 1 or claim 7 wherein said ferrule has an interior surface including a plurality of annular serrations, said plurality of serrations providing electrical connections with a conductive sheath of the coaxial cable by movement of said first end of said entry body along said exterior surface of said ferrule when said entry body is integrated with said clamp nut.

17. The coaxial connector of claim 1 or claim 7 further comprising an o-ring holder centrally disposed along a common longitudinal axis within said clamp nut, said o-ring holder adjacent to a second end of said ferrule, said o-ring holder having an annular race disposed about an outside surface thereof.

18. The coaxial connector of claim 17 further including a first o-ring disposed within said annular race of said o-ring holder.

* * * * *